US005836191A

United States Patent [19]

Wright

[11] Patent Number: 5,836,191

[45] Date of Patent: Nov. 17, 1998

[54] CONTINUOUS EXTRUSION APPARATUS

[75] Inventor: Anthony Thomas Wright, Ashford, England

[73] Assignee: BWE Limited, Ashford, England

[21] Appl. No.: 737,614

[22] PCT Filed: Mar. 15, 1996

[86] PCT No.: PCT/GB96/00647

§ 371 Date: Nov. 18, 1996

§ 102(e) Date: Nov. 18, 1996

[87] PCT Pub. No.: WO96/29161

PCT Pub. Date: Sep. 26, 1996

[30] Foreign Application Priority Data

Mar. 17, 1995 [GB] United Kingdom ..... 9505379

[51] Int. Cl.[6] ..... B21C 23/00

[52] U.S. Cl. ..... 72/262; 72/342.3

[58] Field of Search ..... 72/262, 342.3, 72/253.1, 467, 468

[56] References Cited

U.S. PATENT DOCUMENTS 4,505,878 3/1985 Childs et al. ..... 72/262
4,732,551 3/1988 East et al. ..... 72/262

FOREIGN PATENT DOCUMENTS 58-86929 5/1983 Japan ..... 72/262
58-148017 9/1983 Japan ..... 72/262
2241660 9/1991 United Kingdom ..... 72/262

*Primary Examiner*—Joseph J. Hail, III
*Assistant Examiner*—Ed Tolan
*Attorney, Agent, or Firm*—Shlesinger, Arkwright & Garvey LLP

[57] ABSTRACT

A tooling assembly for a continuous extrusion apparatus includes a die top positioned in a shoe arranged to be urged into contact with a rotating wheel having a circumferential groove. An abutment body is positioned as a sliding fit in a recess provided in the die top and is formed with a spine arranged to project into the circumferential groove and with shoulders flanking the spine arranged to co-act with the cylindrical surface of the wheel adjacent an abutment face. The abutment face lies in a plane inclined slightly to an axial plane through the wheel and the faces on the abutment body seating on faces of the recess are aligned such that forces arising during extrusion act to urge the abutment body into the recess. Where the wheel is formed with a plurality of circumferential grooves, either a corresponding plurality of abutment bodies and associated recesses in the die top are provided or a composite abutment body having spines and shoulders formed as lands intermediate the spines seating in a single recess in the die top is provided. The spine and shoulders are of a linear form, thereby facilitating manufacture. In addition, replacement of the abutment is greatly facilitated in comparison with previous arrangements in which the abutment was integral with, or bolted to, the die top.

6 Claims, 2 Drawing Sheets

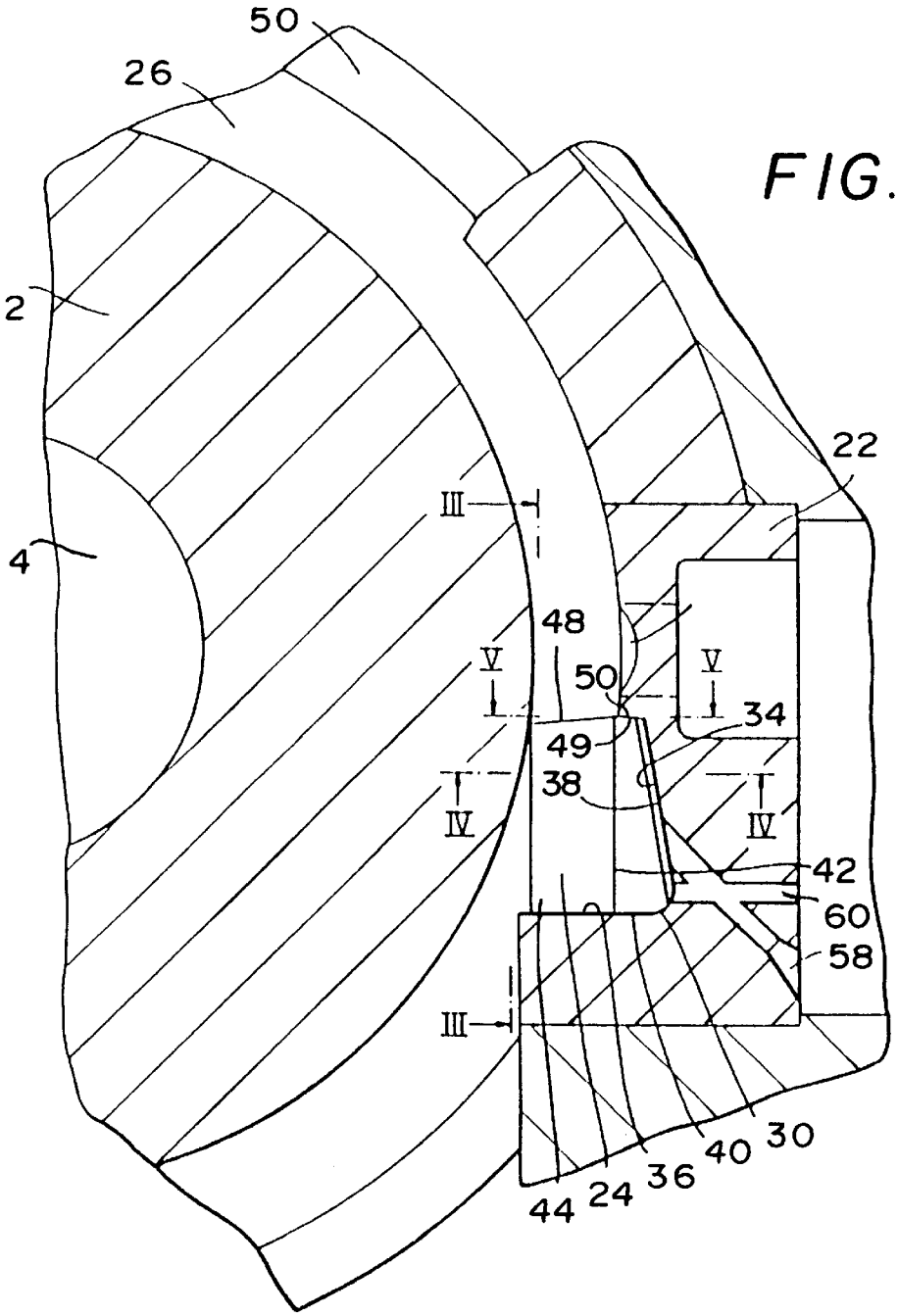
FIG. 2
FIG. 4
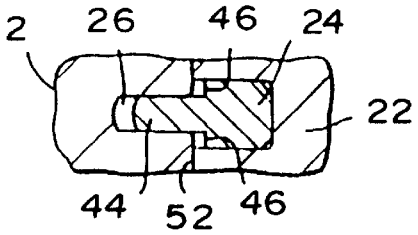
FIG. 5
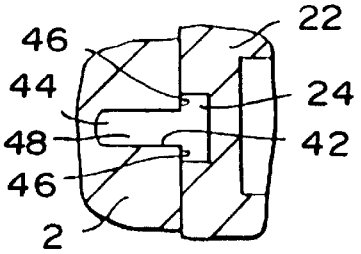

CONTINUOUS EXTRUSION APPARATUS

This invention relates to apparatus for the forming of metals by a continuous extrusion process in which feedstock is introduced into a circumferential groove in a rotating wheel to pass into a passageway formed between the groove and arcuate tooling extending into the groove.

EP-A-071 490 discloses continuous extrusion apparatus having a rotatable wheel formed with a circumferential groove, arcuate tooling bounding a radially outer portion of the groove provided with an exit aperture and an abutment face displaced in the direction of rotation from the exit aperture.

According to the present invention the arcuate tooling includes a die top formed with the exit aperture and a wedge-shaped recess accommodating an abutment body, the abutment body having a face provided with a spine flanked by shoulders arranged to co-act with a cylindrical surface of the wheel flanking the circumferential groove, a face remote from the abutment face arranged to co-act with a complementary face of the wedge-shaped recess and, with the abutment body in register with the wheel, lying on a plane parallel to and displaced from an axial plane containing the wheel axis such that a component of forces arising upon the abutment face serving to displace feed material from the circumferential groove to the exit aperture upon rotation of the wheel acts in a direction urging the abutment body into the wedge-shaped recess.

Preferably, a portion of the abutment face lies in a plane inclined slightly from an axial plane.

Desirably, the spine on the abutment body is of linear form.

Advantageously, where the wheel is formed with a plurality of circumferential grooves, the abutment body is formed with a corresponding plurality of spines providing a plurality of abutment faces separated and flanked by shoulders arranged, adjacent the abutment faces, to co-act with the cylindrical surface of the wheel.

The invention will now be described, by way of example, with reference to the accompanying, partly diagrammatic drawings, in which:

FIG. 2 is a portion of FIG. 1 to an enlarged scale;

FIG. 4 is a scrap cross-section taken on the line IV—IV indicated in FIG. 2; and FIG. 5 is a scrap cross-section taken on the line V—V indicated in FIG. 2.

Figure 1:
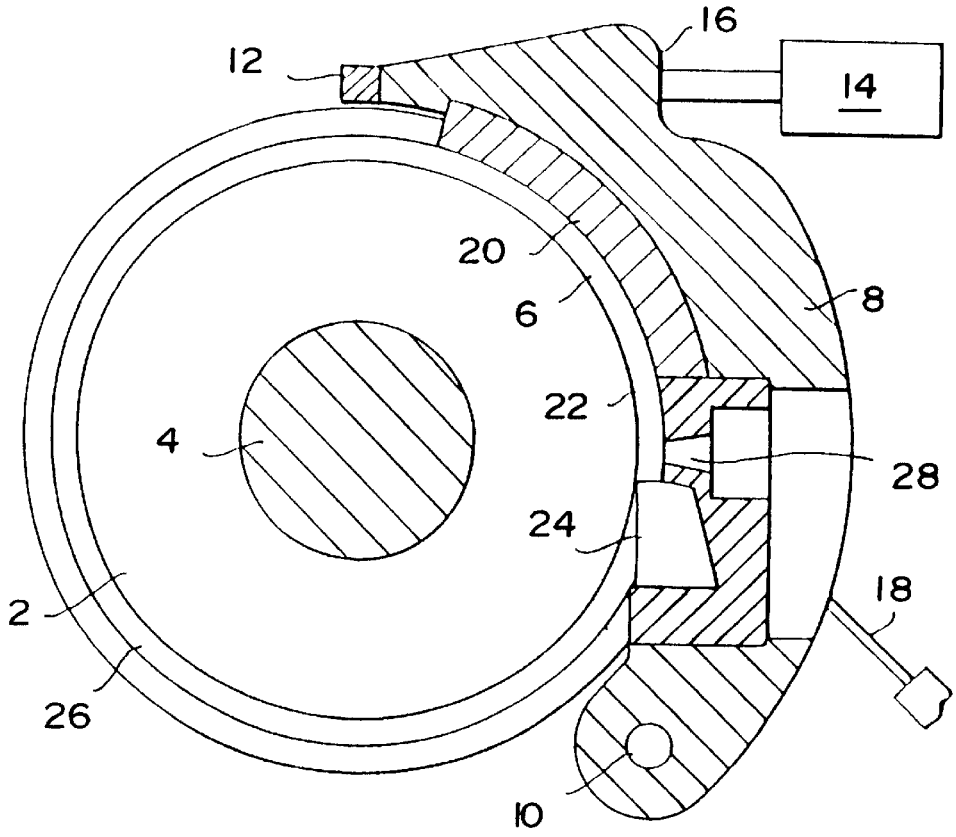
FIG. 1 is a cross-sectional side elevation of a continuous extrusion apparatus, taken on a central plane.
Figure 3:
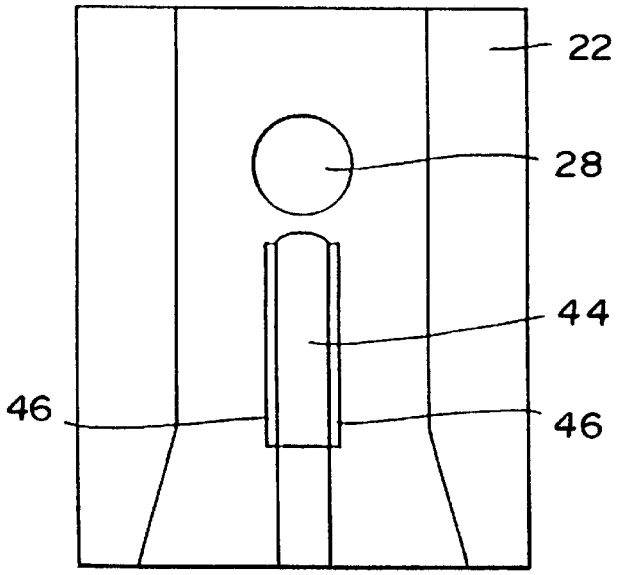
FIG. 3 is an end elevation of a die top included in the apparatus and taken in the direction III—III indicated in FIG. 2.

As shown in FIG. 1 the continuous extrusion apparatus includes a circumferentially grooved wheel 2 mounted on a horizontal drive shaft 4 running on bearings (not shown) positioned on a bed (not shown). Arcuate tooling 6 is positioned in a shoe 8 mounted on a pivot 10 extending parallel to the horizontal drive shaft 4 and urged against a stop 12 positioned adjacent the wheel 2 and above the drive shaft 4 by means of a main hydraulic ram 14 bearing against a shoulder 16 formed on the shoe. A support ram 18 is provided to pivot the shoe 8 into, or out of, registration with the wheel 2. The tooling 6 includes a shoe insert 20, a die top 22 and an abutment body 24 positioned in the shoe 8 to register with the wheel. The shoe insert 20 serves, when the shoe is in position adjacent the stop 12, to form a closure to the adjacent portion of the circumferential groove 26 in the wheel as the wheel rotates past the shoe insert. The die top 22 forms a continuation of the shoe insert 20 and also forms a closure to the adjacent rotated portion of the circumferential groove. The abutment body 24 extends into the circumferential groove 26 to form an obturation of the groove and cause displacement of feed material in the groove 26 through an exit aperture 28 and effect extrusion.

As shown to an enlarged scale in FIGS. 2, 3, 4 and 5, the abutment body 24 is positioned in a corresponding recess 30 in the die top 22 and is of a generally wedge-shaped form having a rectangular cross-section in a plane parallel to a plane axial of the wheel. Thus, the abutment body 24 has faces 34, 36 seating against faces 38, 40 of the recess 30 of rectangular form. Adjacent the wheel 2, the abutment body 24 is of generally rectangular cross-sectional form and has a face 42 provided with a central spine 44 flanked by a pair of planar shoulders 46.

Adjacent the exit aperture 28, the spine 44 has an end portion forming an abutment face 48 conforming to the groove 26 in the wheel 2. Rearwardly of the abutment 48, the spine 44 and shoulders 46 being of linear form, diverge from the cylindrical surface 50 of the wheel flanking the groove 26 and the base of the groove. The exit aperture 28 has a central axis lying in an axial plane of the wheel. The face 40 of the recess 30 lies on a plane parallel to the plane containing the central axis of the exit aperture 28 such that a component of forces arising upon the abutment face 48 serving to displace feed material from the groove 26 to the exit aperture 28 upon rotation of the wheel 2 reacts on the face 40 in a direction urging the abutment body 24 into the wedge-shaped recess 30.

A root portion 49 of the abutment face 48 is tapered to register with a complementary face 50 of the recess 30 to facilitate insertion of the abutment body 24 into, and removal of the abutment body 24 from, the recess 30.

The arrangement facilitates the supply of coolant to the abutment body in that passageways (not shown) in the abutment body 24 register with passageways 58, 60 in the die top 22 connected to a source of supply of coolant. Since the face 34 of the abutment body 24 mates closely with the face 38 of the recess 30 leakage of coolant is minimal.

It will be appreciated that in continuous extrusion apparatus in which the wheel 2 is formed with a plurality of circumferential grooves 26, provided with a common die top 22, either separate abutment bodies 24 as hereinbefore described may be positioned in corresponding recesses 30 in the die top 22 in registration with the respective grooves 26 or a single abutment body formed with a plurality of spines 44 registering with the respective grooves and with shoulders 46 formed as lands intermediate the spines co-acting, adjacent the abutment faces 48, with the cylindrical surface 52 of the wheel may be positioned in a recess of appropriate width in the die top. In such arrangements, the abutment faces 48 may be formed with a slight angular offset to give rise to a compensatory force component countering forces arising as a result of the offset of the abutments from the central plane of the wheel.

Hitherto, continuous extrusion apparatus has incorporated abutment blocks bolted into, or otherwise secured in, the shoe 8 and having a face of cylindrical form conforming to the cylindrical surface of the wheel abutting the wheel 2. Contact force between such an abutment block and the wheel 2 is entirely dependent upon the force exerted by the main hydraulic ram 14 upon the shoe 8 to limit leakage of feed material past an abutment portion. In addition, as a result of requiring the convex cylindrical form face such an abutment block is relatively expensive to manufacture. Should it become necessary to replace such an abutment block the complete set of arcuate tooling requires dismantling as a result of the manner in which the abutment block is secured in the shoe.

Compared with such an abutment block as utilised previously, the abutment body 24 of the present invention is relatively cheaper and easier to manufacture. Since the abutment body 24 is merely lodged in the recess 30, replacement may be effected with no disturbance of the other components of the arcuate tooling. Moreover, by arranging that the alignment of the recess 30 and the form of the abutment body 24 combine to produce a component of reaction forces serving to urge the abutment body 24 into the wedge-shaped recess 30, leakage of feed material past the abutment is reduced without having to increase the loading exerted by the main ram 14 on the shoe 8.

It will be appreciated that the invention also includes an abutment body 24 as hereinbefore described.

I claim:

1. A continuous extrusion apparatus, comprising:

a) a rotatable wheel having an axis, a circumferential groove and a cylindrical surface;

b) an arcuate tooling bounding a radially outer portion of said groove;

c) said tooling having a die top with an exit aperture and a wedge-shaped recess having a complementary seating face;

d) said tooling having an abutment body with a spine providing an abutment face, a first and second shoulder flanking said spine adjacent said abutment face and being operatively adapted to co-act with said cylindrical surface, and a seating face being remote from said abutment face and being operatively adapted to co-act with said complementary seating face;

e) said abutment body being operatively adapted to register with said wheel and being disposed within said wedge-shaped recess on a plane parallel to and displaced from an axial plane containing said wheel axis; and, f) said abutment body being urged into said wedge-shaped recess by component forces arising at said abutment face from the displacement of a feed material from said circumferential groove to said exit aperture upon rotation of said wheel.

2. A continuous extrusion apparatus, as recited in claim 1, wherein:

a) said abutment face lies in a plane being slightly inclined from said axial plane.

3. A continuous extrusion apparatus, as recited in claim 1, wherein:

a) said recess further includes a complementary root face; and, b) said abutment body further includes a root face adjacent said abutment face and tapered to operatively register with said complementary root face.

4. A continuous extrusion apparatus, as recited in claim 1, wherein:

a) said spine is of a generally linear form.

5. A continuous extrusion apparatus, as recited in claim 1, wherein:

a) said abutment body further includes coolant channels within said abutment body; and, b) said die top further includes coolant passageways extending through said die top and being operatively adapted to register with said coolant channels.

6. A continuous extrusion apparatus, as recited in claim 1, wherein:

a) said wheel includes a plurality of circumferential grooves; and, b) said abutment body includes a plurality of spines that provide a plurality of abutment faces, said plurality of spines being separated and flanked by a plurality of shoulders arranged adjacent said abutment faces to operatively co-act with said cylindrical surface.

* * * * *